United States Patent [19]

Straza et al.

[11] Patent Number: 4,679,792

[45] Date of Patent: Jul. 14, 1987

[54] GOLF PUTTER

[76] Inventors: George T. Straza; George C. P. Straza, both of P.O. Box 1292, Rancho Santa Fe, Calif. 92067

[21] Appl. No.: 824,166

[22] Filed: Jan. 30, 1986

Related U.S. Application Data

[63] Continuation of Ser. No. 632,373, Jul. 19, 1984, abandoned.

[51] Int. Cl.[4] ..... A63B 53/04

[52] U.S. Cl. ..... 273/78; 273/173; 273/DIG. 3

[58] Field of Search ..... 273/78, 173, 174, 175, 273/167 J, 167 F, 169, 171

[56] References Cited

U.S. PATENT DOCUMENTS

| | | | |
|---|---|---|---|
| 1,094,599 | 4/1914 | Samson | 273/78 |
| 1,383,654 | 7/1921 | Mattern | 273/173 |
| 2,429,351 | 10/1947 | Fetterolf | 273/78 |
| 3,172,667 | 10/1947 | Baker et al. | 273/78 |
| 3,695,618 | 10/1972 | Woolley et al. | 273/78 X |
| 3,817,522 | 6/1974 | Simmons | 273/78 |
| 3,847,399 | 11/1974 | Raymont | 273/78 X |
| 3,852,150 | 12/1974 | Weller | 273/78 X |

*Primary Examiner*—George J. Marlo

*Attorney, Agent, or Firm*—Brown, Martin Haller & Meador

[57] ABSTRACT

A golf putter head has a body with a cavity in its front face containing an insert member having a front, ball striking face co-planar with the front face of the body. The insert member comprises a honeycomb cellular structure with the cells of the structure filled with a resilient, epoxy material. The walls of the cellular structure are mounted in the cavity perpendicular to the inclined club striking face surface and have exposed cell edges co-planar with the surface of the resilient material and the club striking face surface for simultaneously impacting a golf ball. The putter head is further formed to have an upwardly curving sole. A curved neck attaches the head to the club shaft to position the striking face in line with the axis of the club shaft.

11 Claims, 4 Drawing Figures

GOLF PUTTER

This is a continuation of application Ser. No. 632,373 filed July 19, 1984 now abandoned.

BACKGROUND OF THE INVENTION

This invention relates to golf clubs, and more particularly to a golf putter for assisting a golfer in improving accuracy in putting.

In achieving a better golf score, putting expertise is of great value to a golfer. Since distances involved in putting are relatively short, and the activity is confined to green areas upon the surface of which a golf ball is rolled to a cup, accuracy is paramount. To achieve a successful shot, the line and distance that the ball is to travel must be carefully assessed by the golfer, and depends upon many factors including the nature of the lie, distance to the cup, condition of the putting surface, and weather conditions. Once this assessment has been made, it is of great importance that the putter used by the golfer contribute to propelling the ball in the selected direction for the desired distance. Considerable latitude is allowed in putter designs, and numerous configurations to achieve greater accuracy have been employed. Typically, putters have a weighted club head with a flat ball striking surface. The stroke is usually made by swinging the club pendulum fashion with the momentum to be imparted to the ball by the club head controlled by the amount of the back swing. However, the greater the back swing arc, the more difficult it is to control the desire direction. It is more desirable therefore, to have a putter head which is configured to assist in establishing and initiating the desired line of ball travel, while at the same time increasing the momentum imparted to the ball by incorporation of a resilient impact feature which can provide equivalent momentum with a shorter back swing. It is also desirable to have the resilient impact feature protected from damage and wear for long usage, and to have the club striking face contribute to the accuracy of the ball movement. Applicants' invention fulfills these and other requirements.

SUMMARY OF THE INVENTION

According to the invention, a golf putter head has been devised for attachment at the end of a club shaft wherein the ball striking face of the head has a resilient section for increasing the momentum imparted to a golf ball upon impact. In the illustrated embodiment, the resilient section includes a honeycomb cellular structure positioned in a cavity formed in the front face of the club head and having a front face coplanar with the club head front face to form a ball striking face. The walls of the cells are positioned in the cavity perpendicular to the striking face and the cells are filled with a resilient epoxy which is also used to secure the cellular structure in the cavity. The exposed ends of the cells and the individual cell epoxy surfaces are co-planar with the surface of the club striking face so as to impact a golf ball simultaneously. The cellular configuration serves to protect and preserve the resilient surfaces, and the exposed edges of the cells contact the ball on impact to prevent slippage and enhance the directional control of the ball line of travel. An inward and upward inclination of the striking face serves to accentuate ball roll in the selected direction enhancing the effect produced by the cell end ball contact. The club head is formed to have an upwardly curved sole surface to limit the sole area contacting the ground to an area substantially below the longitudinal center of the resilient surface to aid in the alignment of the club head when addressing a golf ball, and to minimize deflecting ground contact when making the putting stroke.

It is an object of the invention to provide a new and an improved golf putter. The putter head of the disclosed embodiment provides for greater momentum being supplied to a golf ball for comparable back swings, and thus easier control of the club in initiating the desired direction and distance of ball travel. The resilient surface of the club striking face is protected by having the resilient material supported within a cellular structure. Other capabilities and advantages of the invention will become apparent upon reading the following detailed description in conjunction with the drawings in which like numerals referred to like parts throughout, and in which:

DETAILED DESCRIPTION OF THE DRAWINGS

Figure 1:
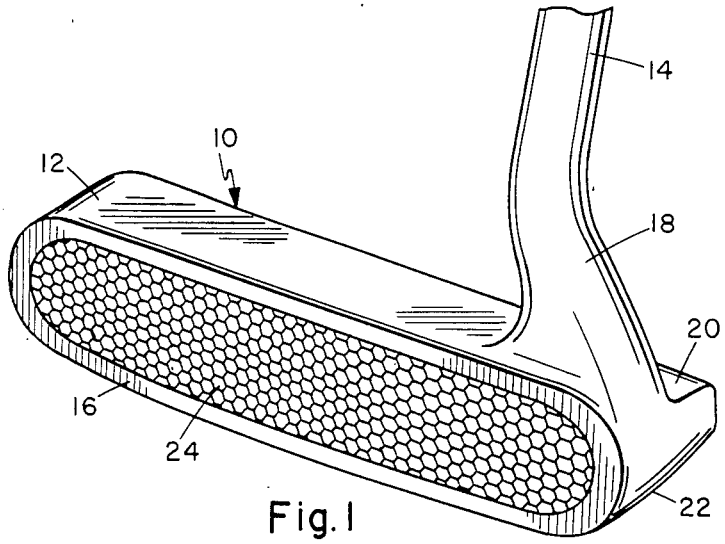
FIG. 1 is a perspective view of the putter head incorporating the resilient striking surface.
Figure 2:
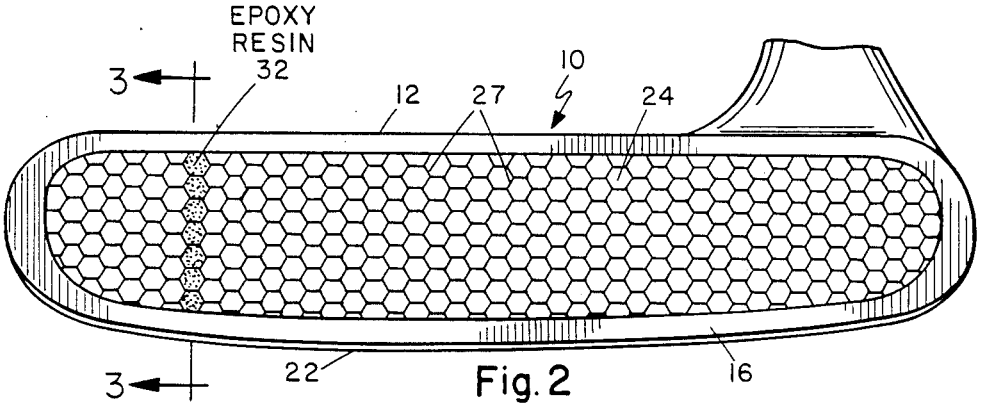
FIG. 2 is an enlarged front view of a putter head.
Figure 3:
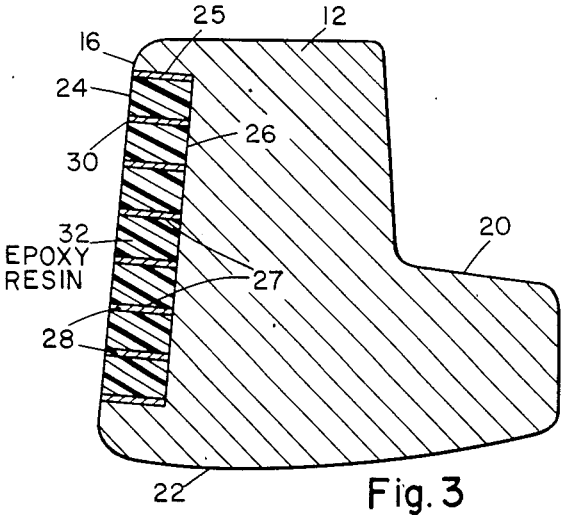
FIG. 3 is an enlarged sectional view taken on line 3—3 of FIG. 2.
Figure 4:
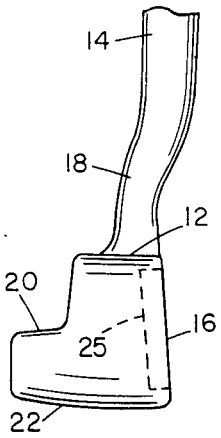
FIG. 4 is end view of the putter head.

The putter 10 and its principal structural features are illustrated in FIGS. 1 and 3. A club head 12 is formed at one end of a golf club shaft 14, only a portion of which is depicted. The club head member 12 has a curved neck porion 18 to position the front face 16 substantially in line with the axis of the club shaft 14. In the embodiment illustrated, the front face 16 is formed as an elongated planar surface backed by an L-shaped portion 20 of the club head, as illustrated in FIG. 3, to provide weight and balance for the putter 10. The sole 22 of the club head has an upwardly curved surface both in line with the striking face and perpendicular thereto to minimize ground contact when aligning and stroking a ball. Front face 16 is designed to be perpendicular to the direction of the intended line of the golf ball travel when stroking the ball, and is inclined at an angle of 5 degrees from the vertical toward the club shaft 14 to provide forward role impetus to the ball upon impact. The latter feature tends to preserve the intended line of ball travel. As illustrated in FIGS. 1, 2 and 3, the head member has a cavity 26 in its front face in which an insert member 24 is mounted. The open front face of the cavity has the same general peripheral shape as the elongate head member, but is of slightly smaller dimensions. The insert member is formed by a hexagonal honeycomb cellular structure 25 mounted in the cavity 26, the structure 25 having an exposed front face co-planar with the front face of the club head to form a ball striking face. The shape of the cavity 26 in the illustrated embodiment conforms substantially with that of the front face and is ⅛ inch deep. It should understood that the cellular structure need not be as extensive as that illustrated to achieve the advantages of the invention. The cellular structure 25 is secured in the cavity 26 with the walls 28 of the individual cells of the structure 25 substantially perpendicular to the plane of the striking face 16, and with the exposed cell ends 30 being co-planar with the surface of the striking face 16. As seen in FIG. 1, the cell density of the insert member is of the order of 120 cells per square inch. The thickness of the insert member is relatively small as compared with the overall thickness of the head 12, as best seen in FIG. 3, so that the insert member forms a thin layer covering most of the area of the front face of head 12. A resilient material 32 fills the cellular spaces 27 of the structure 25 to the surface of the striking face 16 such that the exposed surface of the resilient material is also co-planar with that of the striking face 16. In the illustrated embodiment thermo-setting epoxy resin is employed as the resilient material for contacting the golf ball, and is also used as an adhesive to secure the structure 25 in the cavity 26. Only a portion of the cells 27 of the drawings are depicted as being filled with epoxy in the interest of drawing clarity. As a consequence of the exposed surface of the resilient material 32 and the cell ends 30 being substantially co-planar, they contact a golf ball simultaneously with the striking face 16 when putting. The deformation response of the resilient area 32 give added impetus to the ball, while the contact of the ends 30 tends to prevent slippage between the striking face 16 and the golf ball to improved the control thereof.

OPERATION

Use of the putter 10 maybe explained in conjunction with FIGS. 1 and 3. A golf ball, not shown, is addressed and impacted by the exposed resilient surfaces 32 of epoxy contained within the cells 27 of the club striking face 16. Alignment of the club 10 with the ball to produce the desired direction of travel is facilitated by the curved neck portion 18 positioning the striking face 16 in line with the axis of the club shaft 14. The proper alignment and stroking of the ball is further facilitated by the curved sole surface 22. Ground contact of the sole of the club is limited by the curvature to an area at the center of the striking face during such alignment. The curvature also minimizes ground contact during the stroke to lessen the possibility of deflecting the club head 12.

The inward inclination of the striking face 16 acts in conjunction with the contact control features of the exposed cell ends 30 to prevent slippage between the ball and striking face 16 and imparts forward roll to the ball tending to preserve its line of travel. When the ball is stroked, the deformation response of the multiple resilient surface areas 32 gives added impetus to the ball allowing a shorter and thus more easily control back swing when the putt is made.

Having described our invention, what is claimed is:

1. A golf putter head having a front, ball-striking face for hitting a golf ball, comprising:

a head member of generally elongate shape for securing to an end of a golf club shaft so that it extends generally perpendicular to the shaft, the head member being formed with a generally flat front face having a cavity of the same general elongate peripheral shape as the body member but of smaller dimensions, the cavity having an inner end wall spaced inwardly from and extending generally parallel to the front face of the body member; and an insert member mounted in the cavity and having a front face co-planar with the front face of the head member surrounding the cavity to form the ball striking face of the club head;

the insert member comprising a honeycomb-like array of open-ended, interconnected cells having common adjoining cell walls defining cellular spaces, the cell walls having a thickness substantially less than the dimensions of each cell formed by the cell walls, and the cell walls extending generally perpendicular to the front face of the head member between the inner end wall and open front face of the cavity with their free outer ends co-planar with the ball striking face, and resilient material filling each of the cells to the level of the ball striking face to leave the outer ends of the cell walls exposed, to form a ball striking face comprising the outer surfaces of the resilient material in each cell and the exposed outer ends of the cell walls.

2. The golf putter head as claimed 1, wherein the resilient material is epoxy resin.

3. The golf putter head as claimed in claim 1, wherein the front face of the head member is inclined at an angle of 5 degrees to the axis of a golf club shaft to which it is secured.

4. The golf putter head as claimed in claim 3, wherein the inner end of the cavity in the head member is inclined at the same angle as the front face.

5. The golf putter head as claimed in claim 1, wherein the cavity is $\frac{1}{8}$ inch deep.

6. The golf putter head as claimed in claim 1, wherein the cell density is of the order of 120 cells per square inch.

7. The golf putter head as claimed in claim 1, wherein the insert member is relatively thin relative to the overall thickness of the head member and forms a thin layer covering most of the front face of the putter head.

8. The golf putter head as claimed in claim 1, wherein the head member has a lower, sole surface which is curved upwardly in directions parallel and perpendicular to the front face of the head member.

9. A golf putter comprising:

a club shaft;

an elongate club head formed at one end of the shaft to extend generally perpendicular to the axis of the shaft, the club head having a generally flat front face;

the front face of the club head having a cavity of the same general shape as the club head and a uniform depth, the front face of the club head and the inner end of the cavity being inclined at the same angle of approximately 5 degrees to the axis of the shaft; and an insert member of shape corresponding to the shape of the cavity mounted in the cavity, the insert member having a front face coplanar with the front face of the head surrounding the cavity to form a ball striking face, the insert member comprising a honeycomb-like array of adjoining open-ended cells separated by common cell walls, with the open outer ends of the cells being coplanar with the ball striking face, and a resilient epoxy resin material filling each of the cells to the level of the ball striking face to form a ball striking face comprising the exposed outer ends of the cell walls and the outer surfaces of the epoxy resin material filling each cell, the insert member forming a relatively thin layer on the front face of the head covering most of the area of the front face.

10. The putter as claimed in claim 9, wherein the cell density of the insert member is of the order of 120 cells per square inch.

11. An insert member for forming the ball striking face of a golf putter head, the member comprising:

a cellular structure having an outer periphery of the same general shape as the elongate outer periphery of a golf putter head, a generally flat front face, and a thickness substantially less than the thickness of a putter head, for mounting in a correspondingly shaped cavity in the front face of a golf putter head with the front face of the structure coplanar with the front face of the putter head;

the cellular structure comprising a honeycomb-like array of adjoining open ended cells with their central axes perpendicular to the front face of the array, adjacent cells being separated by common cell walls, and a resilient material filling each of the cells to the level of the front face so as to leave the outer ends of the cell walls exposed.

* * * * *

UNITED STATES PATENT AND TRADEMARK OFFICE

CERTIFICATE OF CORRECTION

PATENT NO. : 4,679,792

DATED : July 14, 1987

INVENTOR(S) : George T. Straza, et al.

It is certified that error appears in the above-identified patent and that said Letters Patent is hereby corrected as shown below:

Claim 2, column 4, line 12, after "claimed" insert --in Claim--;

Signed and Sealed this

Twenty-fourth Day of November, 1987

*Attest:*

DONALD J. QUIGG

*Attesting Officer*

*Commissioner of Patents and Trademarks*